United States Patent [19]

Seon et al.

[11] Patent Number: 4,725,312

[45] Date of Patent: Feb. 16, 1988

[54] PRODUCTION OF METALS BY METALLOTHERMIA

[75] Inventors: Francoise Seon, Montreuil; Philippe Nataf, Paris, both of France

[73] Assignee: Rhone-Poulenc Chimie, Courbevoie, France

[21] Appl. No.: 20,362

[22] Filed: Mar. 2, 1987

[30] Foreign Application Priority Data

Feb. 28, 1986 [FR] France ..... 86 02792

[51] Int. Cl.[4] ..... C22G 59/00

[52] U.S. Cl. ..... 75/84.5; 75/84.4; 75/0.5 BB

[58] Field of Search ..... 75/84.4, 84.5, 0.5 BB

[56] References Cited

U.S. PATENT DOCUMENTS

| | | | |
|---|---|---|---|
| 3,966,458 | 6/1976 | Spink | 75/84.5 |
| 4,032,328 | 6/1977 | Hurd | 75/84.4 |
| 4,149,876 | 4/1979 | Rerat | 75/0.5 BB |
| 4,252,564 | 2/1981 | Banken et al. | 75/84.4 |
| 4,295,884 | 10/1981 | Hicter et al. | 75/84.4 |
| 4,468,248 | 8/1984 | Megy | 75/84.4 |
| 4,556,420 | 12/1985 | Evans et al. | 75/84.5 |
| 4,602,947 | 7/1986 | McClincy et al. | 75/84.4 |
| 4,668,287 | 5/1987 | Kwon | 75/84.5 |
| 4,680,055 | 7/1987 | Sharmon | 75/84.5 |

*Primary Examiner*—Stephen J. Lechert, Jr.

*Attorney, Agent, or Firm*—Burns, Doane, Swecker & Mathis

[57] ABSTRACT

The metals of Groups (IV)(B) or (V)(B) of the Periodic Table, or of the lanthanide series, e.g., titanium metal, are conveniently produced, notably in powder form, by reducing a salt of such a metal by contacting same with liquid admixture comprising lithium metal maintained dispersed in a bath of molten salts.

20 Claims, No Drawings

PRODUCTION OF METALS BY METALLOTHERMIA

BACKGROUND OF THE INVENTION

1. Field of the Invention

The present invention relates to the production of metals in powder form by metallothermia, and, more especially, to the production of metals of Groups (IV)(B) or (V)(B) of the Periodic Table of Elements, or metals of the lanthanide series thereof, by lithiothermia.

This invention is particularly adopted for the production of a very pure titanium in powder form.

2. Description of the Prior Art

Techniques have long been known to this art for producing titanium, zirconium or the rare earths by reducing their chlorides with a powerful reducing agent, such as magnesium, sodium or calcium.

In the Kroll process, for example, titanium tetrachloride is chemically reduced by magnesium at about 1000° C. according to the reaction scheme:

$$TiCl_4\ (g) + 2\ Mg\ (l) \rightarrow Ti\ (s) + MgCl_2 \qquad (1)$$

The operation is carried out discontinuously in a steel reactor and in an inert atmosphere (helium or argon). The metallic titanium is then liberated in the form of sponge immersed in molten $MgCl_2$. The sponge contains about 30% of its weight in impurities, particularly magnesium and magnesium chloride which are carried along when the sponge is precipitated. To obtain a very pure metal, the magnesium and chloride thereof must be distilled under a very high vacuum, a long and delicate operation which consumes great amounts of energy. The purified sponge is dried and then ground to obtain a titanium powder.

Another known process, similar to the Kroll process, but which uses sodium instead of magnesium at the stage where the $TiCl_4$ is chemically reduced, has been styled the Hunter process. In this case, the titanium sponge forms at the center of the reactor and the solidified reaction medium is broken up by explosive agents, crushed, purified, and then dried in a stream of hot nitrogen.

U.S. Pat. No. 2,913,332 proposes the use of lithium as a reducing agent in the manufacture of titanium.

In this process, liquid titanium tetrachloride is poured onto a sheet of molten lithium floating on a bath of molten salts. The advantage of such a method over those described above is the fact that one can operate within much lower temperature ranges, on the order of 500° C. This makes it possible to minimize pollution of the metal by the reactor materials, and also to use a simpler and thus less expensive technology.

Nonetheless, here again the titanium produced is in the form of sponge containing impurities, such as lithium and lithium chloride, which are transferred when the sponges are precipitated in the bath of molten salts.

In all cases, these processes thus have the marked disadvantage of producing metallic sponges which are difficult to purify. Other than the expensive and delicate purifying operations, particularly by distillation under vacuum, such processes also require an additional grinding stage to convert the desired metal into powder form.

SUMMARY OF THE INVENTION

Accordingly, a major object of the present invention is the provision of an improved process for the production of metals directly, essentially in powder form, which improved process not only avoids the necessity for a subsequent grinding stage, but also enables purification of the resulting metal far more easily and economically.

Another object of this invention is the provision of a continuous process for the production of the metals, in which the yields are improved and costs reduced, principally because of the ease with which the product is purified.

Briefly, this invention features production of metals of Groups (IV)(B) or (V)(B) of the Periodic Table of Elements, or of the lanthanide series, by reducing a salt of that metal with lithium, and comprises contacting said salt with liquid mixture comprising lithium which is maintained dispersed in a bath of molten salts.

Surprisingly, the subject process makes it possible to obtain good yields of metal directly, essentially in powder form, and such powder is readily and easily purified.

DETAILED DESCRIPTION OF THE PREFERRED EMBODIMENTS OF THE INVENTION

More particularly according to the present invention, in the description that follows, by the expressions "metal to be produced" or "metal to be reduced", are intended any metal from Groups (IV)(B) or (V)(B) of the Periodio Table, or of the lanthanide series.

The process of the invention is especially applicable for the production of titanium.

The metal to be produced is thus initially in the form of one of its salts.

As a practical matter, a halide is selected, although any other salt known to those skilled in this art may be suitable for the subject process. In the particular case of titanium, titanium tetrachloride or tetrabromide can be used directly, respectively prepared by carbochlorination or carbobromination of rutile $TiO_2$ at about 100° C. However, it is preferable to use titanium tetrachloride, $TiCl_4$.

In the case of neodymium, it is advantageous to use neodymium trichloride.

More generally, for all of the metals concerned, a preferred embodiment of the invention entails using the chlorides of such metals.

The baths of molten salts used according to this invention preferably comprise halide mixtures selected from among the alkali metal halides or alkaline earth metal halides. These mixtures may either be binary or ternary. Exemplary of the binary mixtures which can be used, representative are LiCl and KCl, LiCl and CsCl, LiCl and RbCl, LiBr and KBr, LiBr and CsBr, LiBr and NaNr, LiBr and $SrBr_2$, LiI and CsI.

The ternary mixtures may contain sodium, rubidium, strontium, magnesium, calcium or barium chloride, in addition to the lithium or potassium chloride. Specific examples are LiCl-NaCl-CsCl, LiCl-NaCl-RbCl and LiCl-KCl-KF.

In a preferred embodiment of the invention, the eutectic composition of the mixture is used in order to reduce the melting temperature of the bath to the maximum. The eutectic mixture LiCl-KCl is even more preferred.

The baths and operating conditions are preferably selected such that the temperature of the salt bath ranges from 400° to 550° C., and preferably is about 500° C.

The molten lithium required to reduce the metal salt may advantageously be prepared by the method described in published French Application No. 2,560,221. This process has the advantage of continuously electrolyzing the lithium chloride in a mixture of molten salts, e.g., the binary KCl-LiCl mixture, thereby continuously providing a liquid sheet of molten lithium floating on said salt bath.

Consistent herewith, it is necessary to use a mixture in which the lithium will be maintained dispersed in the bath of molten salts in the reactor.

Any mechanical means that will provide sufficient agitation is suitable for this purpose, particularly an agitator with blades, e.g., with vertical (droites) and inclined blades and a system of opposing blades fixed to the reactor vessel.

The width of the opposing blades is advantageously about one-tenth of the diameter of the reactor vessel. The speed of agitation will obviously vary depending on the size of the vessel. For example, the agitator with blades may have peripheral rotating speeds in excess of 1.3 m/s, and more particularly in excess of 1.9 m/s.

When there is insufficient agitation, a mixture of powder and sponge is generally obtained, the proportion of sponge increasing as the speed of agitation is reduced.

When the intimate admixture of lithium with the bath of molten salts has been obtained and maintained, the metal salt to be reduced is then contacted with said mixture.

The metal salt may be introduced in solid, liquid or gaseous form.

In the case of titanium, however, it is preferable to use the salt in liquid form.

The metal salt may be contacted with the intimate mixture of lithium and molten salts either at the surface, or within the mixture.

This is preferably carried out in an inert atmosphere, e.g., under argon scavenging.

The amount of lithium present in the mixture must correspond at least to stoichiometric equality in respect of the metal salt to be reduced. Such reaction may be expressed by the following scheme:

$$MCl_n + n\ Li \rightarrow M + n\ LiCl$$

The metal thus obtained is essentially in powder form. The yield from the lithiothermic reduction is also improved, since generally at least 70% of the metal to be reduced, which is introduced in salt form, is in the metallic state after the reaction.

Since the metal thus prepared is solid within this temperature range, it may easily be separated from the reaction medium, enriched with dissolved lithium chloride from the reaction, which remains in the molten state. Hence, after the reaction, the reduced metal may be separated from the bath by any known means, particularly filtration, thus giving the desired metal, extracted in the form of fine particles, and the mixture of molten salts, for example, LiCl-KCl.

In the metal, in the case of titanium, at least 70% of the particles range from 100 microns to 1 mm in size.

In those cases where the method described in French Application No. 2,560,221 is used, the LiCl-KCl mixture may be recycled overhead to electrolysis, where the lithium is regenerated in the metallic state. The lithium thus regenerated is reused to reduce the desired metal salt. The looping of the operation obviously cuts down on the expenditure of the reducing agent; apart from waste, the amount of lithium contained in the form of Li or LiCl is constant, which serves to alleviate the problems of supplying lithium salts.

The metal particles obtained can then be subjected to purification. In contrast to the conventional methods of preparing these metals as described above, involving purification by lengthy and expensive distillation, it is sufficient here to simply purify the metal by washing with acid. The advantage is a process with low energy consumption.

The washing may be with nitric or hydrochloric acid. It is preferable to use acidified water having a pH of at least 1.5.

The metal thus purified by washing is then dried, eliminating the additional grinding stage, to provide an extremely pure metal powder which is the final product. The powder typically contains at least 80% metal and, in the case of titanium, typically at least 99%.

In order to further illustrate the present invention and the advantages thereof, the following specific example is given, it being understood that same is intended only as illustrative and in nowise limitative.

EXAMPLE

A stainless steel 316 L crucible having an internal diameter of 70 mm was used. The agitating system was a turbine 24 mm in diameter with 6 vertical blades. The crucible was fitted with 4 opposing 5 mm blades.

The bath was a mixture of LiCl-KCl.

Four tests are carried out. Tests 1 and 2 relate to the production of niobium and neodymium. Tests 3 and 4 relate to the production of titanium. These tests were carried out using different speeds of agitation.

When the bath had been separated, the powders obtained were washed with water, acidified with 1 N HCl to pH 1.5. The results are reported in the following Table:

TABLE

| | Test | | | |
|---|---|---|---|---|
| | 1 | 2 | 3 | 4 |
| Bath | | | | |
| LiCl (g) | 112.5 | 120 | 135 | 135 |
| KCl (g) | 137.5 | 145 | 165 | 165 |
| Adjustment(1) with KCl (g) | 53.0 | 125 | 139 | 139 |
| Li (g)(2) | 7.0 | 17.0 | 26.3 (10% excess) | 23.5 (10% excess) |
| $MCl_n$ (g)(3) | 52.0 ($NbCl_5$) | 200.0 ($NdCl_3$) | 160.9 ($TiCl_4$) | 145.3 ($TiCl_4$) |
| Speed of adding $MCl_n$ (g/h) | 60 | 75 | 30 | 30 |
| Temperature at beginning of reaction °C. | 450 | 480 | 500 | 500 |
| Peripheral agitating speed in m/s | 1.9 | 2.1 | 2.3 | 1.8 |
| Metal (g) produced | 14.0 (Nb) | 84.0 (Nd) | 33.8 (Ti) | 28.7 (Ti) |
| Yield % | 78 (Nb) | 73 (Nd) | 83 (Ti) | 78.0 (Ti) |
| Analysis (% by weight) | Nb≧80 Li=0.7 | Nd>98 Li=0.6 | Ti>99 Li=0.04 | Ti>99 Li=0.05 |

TABLE-continued

| | Test | | | |
|---|---|---|---|---|
| | 1 | 2 | 3 | 4 |
| | | | K<0.1 | K<0.1 |

(1)The KCl adjustment corresponded to the amount of KCl to be included in the bath allowing for the formation of LiCl.
(2)This is the amount of Li included in the bath. The excess stated is relative to stoichiometry.
(3)This is the amount of metal chloride included in the bath.

In test No. 3, titanium was obtained, 100% in powder form. In test No. 4, the titanium was in powder and sponge form, in the respective proportions of 64% and 36% by weight.

The titanium powder had the following granulometry: 83% of the particles were from 100 microns to 1 mm in size, 14% were smaller than 100 microns and 3% were larger than 1 mm.

While the invention has been described in terms of various preferred embodiments, the skilled artisan will appreciate that various modifications, substitutions, omissions, and changes may be made without departing from the spirit thereof. Accordingly, it is intended that the scope of the present invention be limited solely by the scope of the following claims, including equivalents thereof.

What is claimed is:

1. A process for the production of a metal of Group (IV)(B) or (V)(B) of the Periodic Table, or of the lanthanide series, which comprises reducing a salt of such metal by contacting same with liquid admixture comprising lithium metal maintained dispersed in a bath of molten salts.

2. The process as defined by claim 1, comprising maintaining said lithium metal dispersed in said bath by mechanical agitation.

3. The process as defined by claim 2, wherein said mechanical agitation is provided by a system of blades and opposing blades.

4. The process as defined by claim 1, further comprising separating the reduced metal from said bath, and thence washing and drying same.

5. The process as defined by claim 1, said bath comprising regenerated lithium metal.

6. The process as defined by claim 1, wherein said metal salt to be reduced is in liquid form.

7. The process as defined by claim 1, wherein said metal salt to be reduced is in gaseous form.

8. The process as defined by claim 1, wherein said metal salt to be reduced is in solid form.

9. The process as defined by claim 1, wherein the amount of lithium metal comprising said bath is that stoichiometrically required for reduction of said metal salt.

10. The process as defined by claim 1, wherein said metal salt to be reduced comprises a halide.

11. The process as defined by claim 10, said halide being a chloride.

12. The process as defined by claim 11, wherein said metal salt to be reduced comprises titanium tetrachloride.

13. The process as defined by claim 11, wherein said metal salt to be reduced comprises neodymium trichloride.

14. The process as defined by claim 11, wherein said metal salt to be reduced comprises niobium chloride.

15. The process as defined by claim 1, said bath of molten salts comprising admixture of alkali or alkaline earth metal halides.

16. The process as defined by claim 15, said bath of molten salts comprising eutectic admixture.

17. The process as defined by claim 16, said bath of molten salts comprising lithium chloride and potassium chloride.

18. The process as defined by claim 1, comprising producing said product metal in powder form.

19. The product of the process as defined by claim 1.

20. The product of the process as defined by claim 18.

* * * * *